US010132151B2

(12) United States Patent
Leitch

(10) Patent No.: US 10,132,151 B2
(45) **Date of Patent: *Nov. 20, 2018**

(54) DOWNHOLE APPARATUS AND METHOD

(71) Applicant: FORUM US, INC., Houston, TX (US)

(72) Inventor: Andrew Leitch, Aberdeen (GB)

(73) Assignee: FORUM US, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/229,369

(22) Filed: Aug. 5, 2016

(65) Prior Publication Data

US 2016/0341026 A1 Nov. 24, 2016

Related U.S. Application Data

(63) Continuation of application No. 13/996,769, filed as application No. PCT/GB2011/052527 on Dec. 20, 2011, now Pat. No. 9,441,435.

(30) Foreign Application Priority Data

Dec. 21, 2010 (GB) ..... 1021588.7

(51) Int. Cl.
*E21B 43/38* (2006.01)
*E21B 43/12* (2006.01)
(Continued)

(52) U.S. Cl.
CPC ..... *E21B 43/38* (2013.01); *E21B 27/005* (2013.01); *E21B 34/08* (2013.01); *E21B 43/08* (2013.01);
(Continued)

(58) Field of Classification Search
CPC ..... E21B 43/38; E21B 43/121; E21B 43/08; E21B 34/08; E21B 43/128; E21B 27/005;
(Continued)

(56) References Cited

U.S. PATENT DOCUMENTS 981,172 A 1/1911 Conrader
1,431,006 A 10/1922 Kelsey
(Continued)

FOREIGN PATENT DOCUMENTS

CN 1955438 A 5/2007
GB 2335687 9/1999
(Continued)

OTHER PUBLICATIONS

Exhibit A-1, Invalidity Chart for U.S. Pat. No. 9,441,435 in view of U.K. Patent Publication 2,411,668 to Benamar et al., Civil Action No. 2:16-cv-01187-RSP, Filed Apr. 4, 2017.
(Continued)

*Primary Examiner* — Michael R Wills, III
(74) *Attorney, Agent, or Firm* — FisherBroyles, LLP

(57) ABSTRACT

A downhole apparatus comprising a body configured to be coupled to a production tubular and an upper opening and a lower opening. First and second flow paths are provided between the upper opening and the lower opening in the body, and a flow diverter is arranged to direct downward flow through the body towards the second flow path and away from the first flow path. A filter device in the second flow path filters or collects solid particles in the second flow path from passing out of the lower opening of the apparatus. The apparatus has particular application to artificial lift hydrocarbon production systems, and may be installed above a downhole pump in a production tubing to prevent solids from settling on the pump during pump shutdown. Embodiments for use with ESPs and PCPs are described.

38 Claims, 7 Drawing Sheets

(51) Int. Cl.

| | |
|---|---|
| ***E21B 43/08*** | (2006.01) |
| ***E21B 27/00*** | (2006.01) |
| ***E21B 34/08*** | (2006.01) |
| *E21B 34/00* | (2006.01) |

(52) U.S. Cl.
CPC ..... *E21B 43/121* (2013.01); *E21B 43/126* (2013.01); *E21B 43/128* (2013.01); *E21B 2034/002* (2013.01); *E21B 2034/005* (2013.01)

(58) Field of Classification Search
CPC ..... E21B 43/126; E21B 2034/005; E21B 2034/002
See application file for complete search history.

(56) References Cited

U.S. PATENT DOCUMENTS

| | | | |
|---|---|---|---|
| 2,858,772 | A | 11/1958 | Brooks |
| 6,167,960 | B1 | 1/2001 | Moya |
| 6,189,617 | B1 | 2/2001 | Sorhus et al. |
| 6,216,788 | B1 | 4/2001 | Wilson |
| 6,250,387 | B1 | 6/2001 | Carmichael et al. |
| 6,276,452 | B1 | 8/2001 | Davis |
| 6,289,990 | B1 | 9/2001 | Dillon et al. |
| 6,698,521 | B2 | 3/2004 | Schrenkel et al. |
| 7,779,901 | B2 | 8/2010 | Davis et al. |
| 8,109,331 | B2 | 2/2012 | Lynde et al. |
| 2005/0121233 | A1 | 6/2005 | Frith |
| 2006/0011345 | A1 | 1/2006 | Delaloye et al. |
| 2009/0200010 | A1 | 8/2009 | Davis et al. |
| 2009/0200012 | A1 | 8/2009 | Davis |
| 2009/0283330 | A1 | 11/2009 | Lynde |
| 2010/0258289 | A1 | 10/2010 | Lynde |
| 2011/0024119 | A1 | 2/2011 | Wolf |
| 2012/0292047 | A1 | 11/2012 | Knobloch, Jr. et al. |

FOREIGN PATENT DOCUMENTS

| | | |
|---|---|---|
| GB | 2409691 | 7/2005 |
| GB | 2 411 416 A | 8/2005 |
| GB | 2411416 | 8/2005 |
| GB | 2 411 668 A | 9/2005 |
| GB | 2411668 | 9/2005 |
| GB | 2434385 | 7/2007 |
| GB | 2442516 | 4/2008 |
| RU | 2 016 186 C1 | 7/1994 |
| WO | WO 2005/083231 A1 | 9/2005 |
| WO | WO 25007/026141 A1 | 3/2007 |

OTHER PUBLICATIONS

Exhibit A-2, Invalidity Chart for U.S. Pat. No. 9,441,435 in view of Chinese Patent Publication No. 1,955,438 to Yang et al., Civil Action No. 2:16-cv-01187-RSP, Filed Apr. 4, 2017.
Exhibit A-3, Invalidity Chart for U.S. Pat. No. 9,441,435 in view of U.S. Pat. No. 6,250,387 to Carmichael et al., Civil Action No. 2:16-cv-01187-RSP, Filed Apr. 4, 2017.
Exhibit A-4, Invalidity Chart for U.S. Pat. No. 9,441,435 in view of U.S. Patent No. 981,172 to Conrader, Civil Action No. 2:16-cv-01187-RSP, Filed Apr. 4, 2017.
Exhibit A-5, Invalidity Chart for U.S. Pat. No. 9,441,435 in view of Paper titled "Auto Flow Valves: Increased Production and Protection" by Zenith Oil Filed Technology Ltd., Apr. 2008, and associated Zenith Auto Flow Valve product, Civil Action No. 2:16-cv-01187-RSP, Filed Apr. 4, 2017.
Exhibit A-6, Invalidity Chart for U.S. Pat. No. 9,441,435 in view of U.S. Pat. No. 6,698,521 to Schrenkel et al., Civil Action No. 2:16-cv-01187-RSP, Filed Apr. 4, 2017.
Exhibit A-7, Invalidity Chart for U.S. Pat. No. 9,441,435 in view of U.K. Patent Application 2,411,416 Shotter et al., Civil Action No. 2:16-cv-01187-RSP, Filed Apr. 4, 2017.
Exhibit A-8, Invalidity Chart for U.S. Pat. No. 9,441,435 in view of U.S. Pat. No. 6,289,990 Dillon et al., Civil Action No. 2:16-cv-01187-RSP, Filed Apr. 4, 2017.
Exhibit A-9, Invalidity Chart for U.S. Pat. No. 9,441,435 in view of WIPO Publication No. 2007/026,141 Jordan et al., Civil Action No. 2:16-cv-01187-RSP, Filed Apr. 4, 2017.
Exhibit A-10, Invalidity Chart for U.S. Pat. No. 9,441,435in view of U.S. Pat. No. 1,431,006 to Kelsey, Civil Action No. 2:16-cv-01187-RSP, Filed Apr. 4, 2017.
Exhibit A-11, Invalidity Chart for U.S. Pat. No. 9,441,435 in view of Russian Patent Publication No. 2,016,186 to Kurochkin, et al., Civil Action No. 2:16-cv-01187-RSP, Filed Apr. 4, 2017.
Exhibit A-12, Invalidity Chart for U.S. Pat. No. 9,441,435 in view of U.S. Pat. No. 2,858,772 to A. B. Brooks, Civil Action No. 2:16-cv-01187-RSP, Filed Apr. 4, 2017.
Exhibit A-13, Exhibit A-#: Claim Chart of Secondary References against U.S. Pat. No. 9,441,435, Civil Action No. 2:16-cv-01187-RSP, Filed Apr. 4, 2017.
Invalidity Contentions Pursuant to Patent Rules 3-3 and 3-4, United States District Court for the Eastern District of Texas (Marshall Division), Civil Action No. 2:16-cv-01187-RSP, Filed Apr. 4, 2017.
"Auto Flow Valves: Increased Production and Protection" by Zenith Oil Filed Technology Ltd., Apr. 2008.

DOWNHOLE APPARATUS AND METHOD

The present invention relates to a downhole apparatus and method, and in particular to a downhole apparatus and method for use in the hydrocarbon production industry. Embodiments of the invention are downhole apparatus used with pumps in oil and gas production systems.

BACKGROUND TO THE INVENTION

Specialised downhole pumps are used in the hydrocarbon exploration and production industry in various applications, and in particular for the production of hydrocarbons to surface from significant wellbore depths. There are several types of downhole pump in use, including Electrical Submersible Pumps (ESPs) and Progressive Cavity Pumps (PCPs). An ESP is typically located at the bottom of the production tubing, and comprises a downhole electric motor powered and controlled from surface by a power cable which connects to the wellhead. ESPs are highly efficient pumps capable of high production rates, and are particularly well-suited to the production of lighter crude oils, and are less capable with heavy crudes.

A PCP, like an ESP, is typically attached to the bottom end of a production tubing. A PCP comprises a rubber stator having a helical internal profile which mates with a rotor having an external screw profile. The rotor is connected to a rotating shaft, which extends through the production tubing and is driven by a surface motor. PCPs are normally specified for their ability to produce heavy crudes.

Downhole pumps are sensitive to sands and other abrasive solids being present in the production fluid. The amount of sand which is produced from a well depends on characteristics of the formation, and various methods are used to control sand production. However, it is common for some amount of sand or abrasive solids to be present in the production fluid. ESPs are particularly sensitive to sand presence due to the nature of their internal components.

With many production systems which use a downhole pump, problems can arise when the pump is shut down after a period of pumping fluid up the production tubing to surface. On pump shutdown, flow ceases very quickly as the fluid levels in the production bore and the annulus equalise. Gravity acting on the sand particles present in the column of fluid above the pump (which could be several thousand meters) causes the sand and any other solids to fall back towards the pump. Due to the complex configuration of the interior features of the pump, there is no direct path for the sand to pass through the pump, and therefore it tends to settle on top of the pump. This can cause the pump to become plugged. When production operations are resumed, a higher load is required to start the pump and push the plug of sand up from the pump. In some cases this can cause motor burnout in an ESP or breaking of the rotor shaft of PCP. Such failure of the downhole pump requires work-over involving pull-out and reinstallation of the completion. This is an expensive and time-consuming operation.

It is amongst the aims and objects of the invention to provide a downhole apparatus and method which addresses the above-described deficiencies of downhole pump systems.

Further aims and objects will become apparent from reading the following description.

SUMMARY OF THE INVENTION

According to a first aspect of the invention there is provided a downhole apparatus comprising:

a body configured to be coupled to a production tubular and comprising an upper opening and a lower opening;

a first flow path between the upper opening and the lower opening in the body;

a second flow path between the upper opening and the lower opening in the body;

a flow diverter arranged to direct downward flow through the body towards the second flow path and away from the first flow path; and a filter device in the second flow path for collecting solid particles in the second flow path.

The downhole apparatus may form a part of a hydrocarbon production system, and may be used during production of hydrocarbons. The apparatus may therefore collect solid particles from a production fluid.

The downhole apparatus therefore functions to filter or collect solids, including sands and other abrasive solids, which may be entrained in fluid present in the second flow path. The fluid may flow downward through the apparatus, in which case the flow diverter directs the fluid flow through the second fluid path, and through the filter device to the lower opening. However, the downhole apparatus also operates when there is no downward fluid flow: solids entrained in the fluid column may flow downward through a stationary fluid to the second flow path and be collected at the filter device of the apparatus.

By diverting the flow to a second flow path for filtering or collection of solids, the first flow path may be maintained without causing build-up of solids or plugging in the first flow path.

The body may be a tubular configured to be assembled into a production tubing, and the first flow path may therefore be arranged to receive the upward flow of production fluid from a hydrocarbon production system. Preferably, the hydrocarbon production system is an artificial lift production system, which may comprise one or more downhole pumps located below the downhole apparatus. The pumps may be Electrical Submersible Pumps (ESPs) or may be Progressive Cavity Pumps (PCPs). Therefore the apparatus may prevent passage of the solids downward through the apparatus and towards a downhole pump. The solids are prevented from passing through or settling on the downhole pump by being collected in the apparatus.

It will be appreciated that the downhole apparatus may be connected to production tubing at the lower opening, or may be installed on a downhole pump with no intermediate tubing or via a specialised connecting sub-assembly.

In a preferred embodiment of the invention, the first flow path is a main throughbore of the apparatus, which is aligned with the main bore of the production tubing. The second flow path may be located in an annular space between the first flow path and a wall of the body. The second flow path may comprise an annular flow path disposed around the first flow path.

Preferably, the first flow path and the second flow path are in fluid communication, and fluid flowing in the first flow path in an upward direction may cause fluid flow in the second flow path which carries filtered or collected solid particles away from the filter device. Thus in a production mode, where production fluid flows upward in the first flow path, the flow may induce collected solids to be progressively washed away from the filter and carried upwards out of the apparatus and into the main production flow stream. The first and second flow paths may be in fluid communication via one or more vents.

Preferably, the flow diverter comprises a valve. The valve may be operable to close the first flow path against flow in a downward direction through the apparatus (thus directing flow to the second flow path). The valve may be operable to open the first flow path when fluid flows in an upward direction in the apparatus. The valve may be biased towards a closed position. The valve may for example be a mushroom valve, a flapper valve, a ball valve, a cone valve or a petal valve. The valve may be configured for intervention, for example to open the valve and/or allow the valve to be removed from the well. The intervention may be a wireline intervention or may be for example by actuation of a sleeve.

The apparatus may be configured to accommodate the passage of a shaft therethrough, such as a drive shaft for a downhole pump. Thus the apparatus may be used with a Progressive Cavity Pump (PCP). In such an embodiment, the flow diverter may comprise a petal valve, which may be a rubber petal valve.

The filter device may comprise a mesh or screen, which may be disposed between the first and second flow paths. The first and second flow paths may be separated by a wall, which may comprise one or more vents. A mesh or screen may be disposed over the one or more vents. The vents may comprise holes, or slots, and may comprise circumferentially or longitudinally oriented slots. Alternatively, the slots may comprise helically oriented slots, or may comprise a combination of slots with different orientations.

Preferably the distribution of the vents is non-uniform, and there may be a greater distribution of vents towards a lower part of the apparatus.

The vents may be formed with a laser cutting tool. Alternatively the vents may be formed with a water jet. The vents may be shaped and/or sized to limit the passage of sand and/or solid particles therethrough. The vents may have a dimension of around 0.5 mm, and may comprise slots of approximately 0.5 mm.

Optionally, the apparatus comprises means for stimulating flow at the bottom part of the second flow path, which preferably includes an axial (or upward) flow component in the second flow path. One or more holes may be arranged between the lower part of the first flow path and the second flow path, for example through the lower subassembly, to receive upward flow from the main flow path. This may direct flow towards a lower surface of a volume of solids collected in the device, assisting with the solids being washed away from a lower part of the second flow path.

One or more vents may comprise a one-way valve, which may comprise a flexible or moveable membrane. The valve may be operable to be closed to flow from the second flow path to the first flow path, and open to flow from the first flow path to the second flow path.

The words "upper", "lower", "downward" and "upward" are relative terms used herein to indicate directions in a wellbore, with "upper" and equivalents referring to the direction along the wellbore towards the surface, and "lower" and equivalents referring to the direction towards the bottom hole. It will be appreciated that the invention has application to deviated and lateral wellbores.

According to a second aspect of the invention there is provided a hydrocarbon production system comprising:

a production tubing;

at least one downhole apparatus of the first aspect of the invention coupled into the production tubing; and at least one downhole pump coupled to the production tubing below the downhole apparatus.

The downhole pump may comprise an ESP or may comprise a PCP. The downhole apparatus may be located in proximity to the downhole pump, for example less than about 50 feet (about 15 m) above the pump and preferably within around 20 to 30 feet (about 6 m to 9 m).

Where the system comprises multiple downhole apparatus, a second downhole apparatus may be located at a greater distance from the pump, for example in excess of 500 feet (150 m) above the downhole pump. In such a configuration, the uppermost downhole apparatus may be equipped for intervention (for example to open a flow diverter to provide full bore access), whereas the lowermost apparatus may not require such a feature.

Embodiments of the second aspect of the invention may comprise preferred or optional features of the first aspect of the invention or vice versa.

According to a third aspect of the invention there is provided a downhole pump assembly comprising a downhole pump and the downhole apparatus according to the first aspect of the invention.

Embodiments of the third aspect of the invention may comprise preferred or optional features of the first or second aspects of the invention or vice versa.

According to a fourth aspect of the invention there is provided a filter apparatus for a downhole pump, the filter apparatus comprising:

a body configured to be coupled to a production tubular above a downhole pump and comprising an upper opening and a lower opening;

a first flow path between the upper opening and the lower opening in the body;

a second flow path between the upper opening and the lower opening in the body;

a flow diverter arranged to direct downward flow through the body towards the second flow path and away from the first flow path; and a filter device in the second flow path for preventing solid particles in the second flow path from passing through the lower opening.

The filter apparatus may form a part of a hydrocarbon production system, and may be used during production of hydrocarbons. The filter apparatus may therefore collect solid particles from a production fluid.

The filter apparatus may be self-cleaning. The first flow path and the second flow path may be in fluid communication, and fluid flowing in the first flow path in an upward direction may cause fluid flow in the second flow path which carries filtered or collected solid particles away from the filter device.

Embodiments of the fourth aspect of the invention may comprise preferred or optional features of the first to third aspects of the invention or vice versa.

According to a fifth aspect of the invention there is provided a method of operating a hydrocarbon well, the method comprising:

providing a production tubular, a downhole pump in the production tubular, and a body coupled to a production tubular above the downhole pump and comprising an upper opening and a lower opening;

in a production mode, operating the downhole pump to cause fluid to flow in a first flow path upward through the body;

ceasing operation of the pump;

directing downward flow of fluid and/or entrained solids to a second flow path in the body; filtering or collecting solid particles in the second flow path.

Preferably the method may be used during production of hydrocarbons.

The method may comprise: operating the pump to cause fluid to flow in the first flow path upward through the body;

inducing fluid flow in the second flow path to carry filtered or collected solid particles upwards through the body. Preferably, the method comprises carrying filtered or collected solid particles out of the upper opening of the body. Preferably, the filtered or collected solid particles are carried progressively from the body, and may be gradually and progressively lifted from the uppermost part of a volume of solids collected in the apparatus.

Embodiments of the fifth aspect of the invention may comprise preferred or optional features of the first to fourth aspects of the invention or vice versa.

BRIEF DESCRIPTION OF THE DRAWINGS

There will now be described, by way of example only, embodiments of the invention with respect to the following drawings, of which.

DETAILED DESCRIPTION OF PREFERRED EMBODIMENTS

Figures 1A, 1B, 1C:
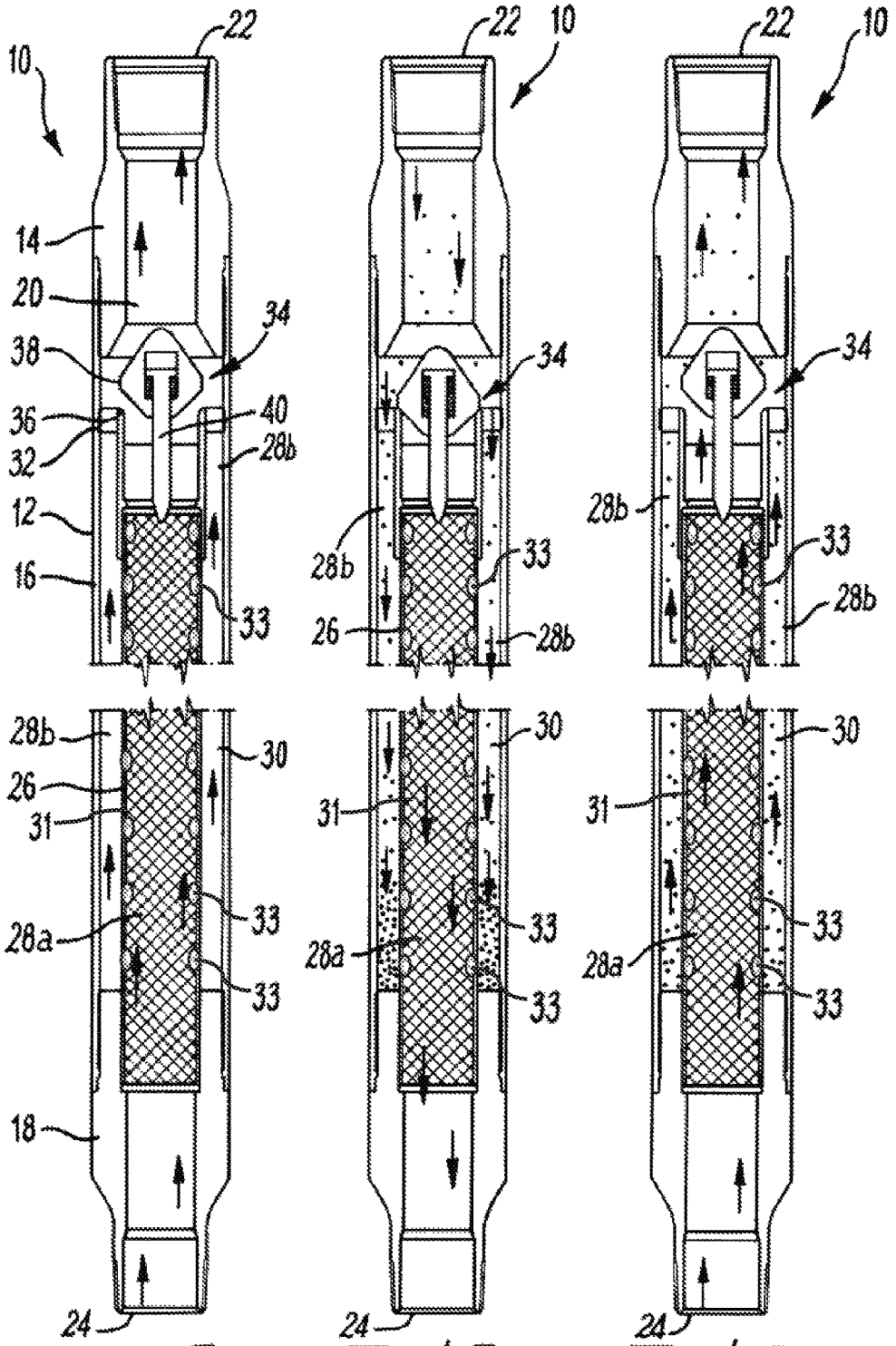
FIGS. 1A, 1B and 1C are sectional views of a downhole apparatus in accordance with a first embodiment of the invention in different phases of operation.

Referring firstly to FIGS. 1A to 1C, there is shown in longitudinal section a downhole apparatus according to a first embodiment of the invention, generally depicted at 10. The apparatus 10 is configured for use in an artificial lift hydrocarbon production system which uses an electrical submersible pump (ESP) to pump hydrocarbons upwards in a production tubing to surface.

The apparatus 10 comprises a body 12 formed from a top sub assembly 14, a pressure retaining housing 16, and a bottom sub assembly 18. The body 12 defines a throughbore 20 between an upper opening 22 and a lower opening 24. The lower opening is coupled to a production tubing above a downhole pump such as an ESP (not shown). The apparatus 10 may be located immediately above the ESP in the production tubing, or there may be intermediate tubing (not shown) between the ESP and the apparatus 10. It is advantageous for the apparatus to be located close to the ESP and the tubing string.

The apparatus 10 also comprises an inner tubular 26 which extends along a part of the body 12. The inner tubular 26 is concentric with the body 12, and is aligned with the lower opening 24 and the upper opening 22 so as to provide a continuation of a main bore of the production tubing. In this embodiment, the inner tubular 26 has an inner diameter approximately equal to the main bore of the production tubing. The inner tubular 26 divides the throughbore 20 into a first flow region 28*a* on the inside of the tubular and a second flow region 28*b* in an annular space 30 between the inner wall of the housing 16 and the inner tubular 26. The inner tubular 26 is vented such that the first flow region 28*a* and the second flow region 28*b* are in fluid communication[ZSD1]. The inner tubular 26 is also provided with a mesh 31 to prevent the passage of solids having a size larger than the apertures in the mesh from passing between the first and second flow regions.

At the upper end of the inner tubular 26 is a valve 34 which functions to divert flow in the apparatus 10. A spider 32 supports the inner tubular 26 and defines a valve seat 36 for a valve member 38. The valve 34 is operable to be moved between an open position, shown in FIGS. 1A and 10, and a closed position shown in FIG. 1B. The valve member 38 is biased towards the closed position shown in FIG. 1B by a spring located between a valve mount 40 and the valve member 38.

Operation of the apparatus will now be described with reference to FIGS. 1A to 1C. In FIG. 1A, the apparatus 10 is shown in a production phase, with the downhole pump operating to cause production fluids to flow upwards through the throughbore (as depicted by the arrows), entering the lower opening 24 and leaving the upper opening 22. As fluid flows into the apparatus 10, it enters the first flow region 28*a* defined by the inner tubular 26. The fluids also enter the second flow region 28*b* through vents 33 in the inner tubular 26, such that fluid also flows upwards in the annular space 30 between the inner wall of the housing 16 and the inner tubular. Here it should be noted that there is no direct flow path from the lower opening 24 to the second flow region which does not pass through the first flow region. The pressure created by the downhole pump acts against the valve member 38 and opens the valve 34, such that fluid flows from the first flow region 28*a* past the valve 34 and out of the upper opening 22. Fluid flowing in the second flow region 28*b* flows past the spider 32 and exits the upper opening 22.

FIG. 1B shows a shutdown phase of the hydrocarbon production system. In this configuration, the downhole pump has been switched off, and fluid is no longer pumped upwards through the apparatus 10. The absence of pressure on the lower surface of the valve member 38 causes the valve 34 to close. This prevents fluid from entering the first flow region from an upper part of the apparatus 10 or from production tubing above the apparatus. Fluid flows downwards in the apparatus 10, as depicted by the direction of the arrows, until the fluid column in the production string equalises with the fluid column in the wellbore annulus. During this downward fluid flow phase, the fluid is diverted into the second flow region 28*b*. Solid particles such as sands entrained in the fluid are also diverted into the second flow region 28*b*. The fluid is allowed to pass into the first flow region 28*a* through vents 33 in the inner tubular 26, and out through the lower opening 24. The mesh 31 functions to screen or filter solid particles such as sands from the fluid, and the solids are collected in the second flow region 28*b*. When the fluid column is at rest and no longer flows through the tool, solid particles continue to fall through the fluid by gravity acting on the solids. Solid particles flowing in the fluid are diverted away from the first flow region 28*a* by the closed valve and into the second flow region 28*b* where they are collected.

FIG. 1C shows a subsequent production phase, after operation of the downhole pump has been resumed. Production fluid is caused to flow upwards through the apparatus 10 and the pump pressure opens the valve 34 to open the first flow region 28*a*. The accumulated solid particles do not generate any significant back pressure on the flow path through the apparatus: the back pressure of the apparatus and valve is known, and can be exceeded within the normal operating parameters of the downhole pump. As fluid flows in the first flow region 28*a* defined by the inner tubular, fluid is also vented to the second flow region 28*b*. This has the effect of inducing fluid flow in the second region 28*b* which lifts and carries sands and solids which have accumulated in the second flow region during the shutdown phase. The sands and solids are entrained in the flow upwards through the apparatus and out of the upper opening 22, into the production tubing. Therefore the accumulated sands and solids are washed from the apparatus during a subsequent production phase.

The apparatus of this embodiment provides a filter system for solids in a production tubing which prevents the solids from settling on, or passing downwards through, a downhole pump. The downhole apparatus filters the solids in a way which does not provide a significant backpressure or resistance to subsequent operation of the pump. In addition, the solids are collected in a manner which allows them to be entrained into a production fluid flow during a subsequent production phase and therefore allows them to be washed from the apparatus. This allows the apparatus to be used for extended periods.

Figure 2:
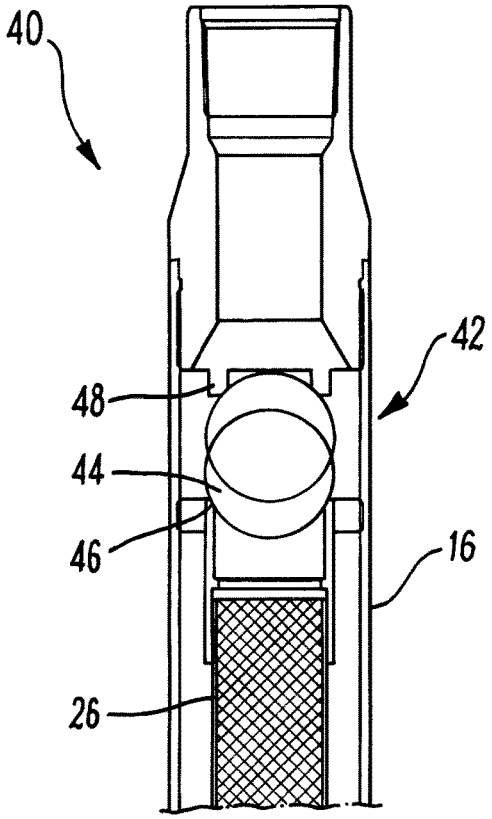
FIGS. 2 and 3 are sectional views of downhole apparatus according to alternative embodiments of the invention.
Figure 3:
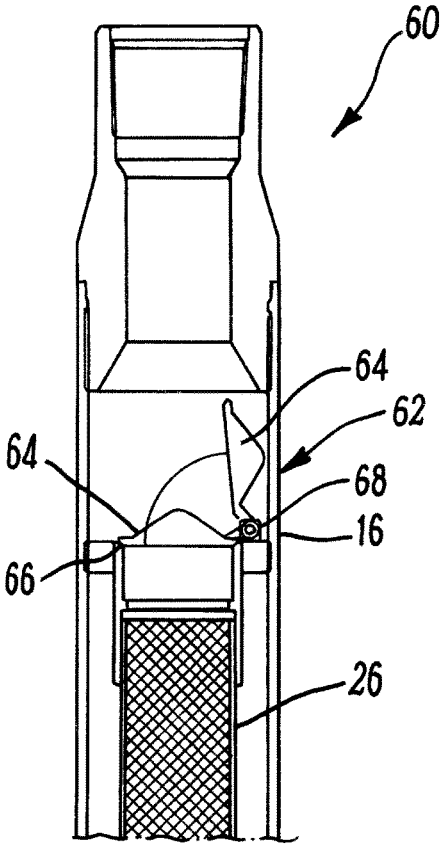

FIGS. 2 and 3 are sectional views of upper parts of two alternative embodiments of the invention. FIG. 2 shows an upper part of an apparatus 40, and FIG. 3 shows an upper part of an apparatus 60. The apparatus 40 and 60 are similar to the apparatus 10, and will be understood from FIGS. 1A to 1C and the accompanying text. However, the apparatus 40 and 60 differ in the valve configuration.

Referring to FIG. 2, the apparatus 40 comprises a ball valve 42, in place of the mushroom-type valve in the apparatus 10. The ball valve 42 comprises a ball 44 which rests on a valve seat 46 to seal the inner tubular 26. A retainer 48 prevents the ball 44 from passing too far upwards in the apparatus 40 under the fluid flow. The ball 44 is selected to be lifted by the fluid flow during a production phase (equivalent to FIGS. 1A and 1C) and rests on the valve seat 46 by gravity during a shutdown phase of the downhole pump (equivalent to FIG. 1B).

FIG. 3 shows an upper part of an apparatus 60, which differs from the apparatus 10 and 40 in the configuration of the valve. In this embodiment, the valve 62 is a flapper-type valve having a valve member 64 which is pivotally mounted on the spider to move between an open position and a closed position on the valve seat 66. In the closed position, the valve prevents fluid flow into an upper part of the inner tubular 26. A biasing member is included in a hinge 68 such that in the absence of upward flow, the valve member 64 rests on the valve seat.

Figure 4A:
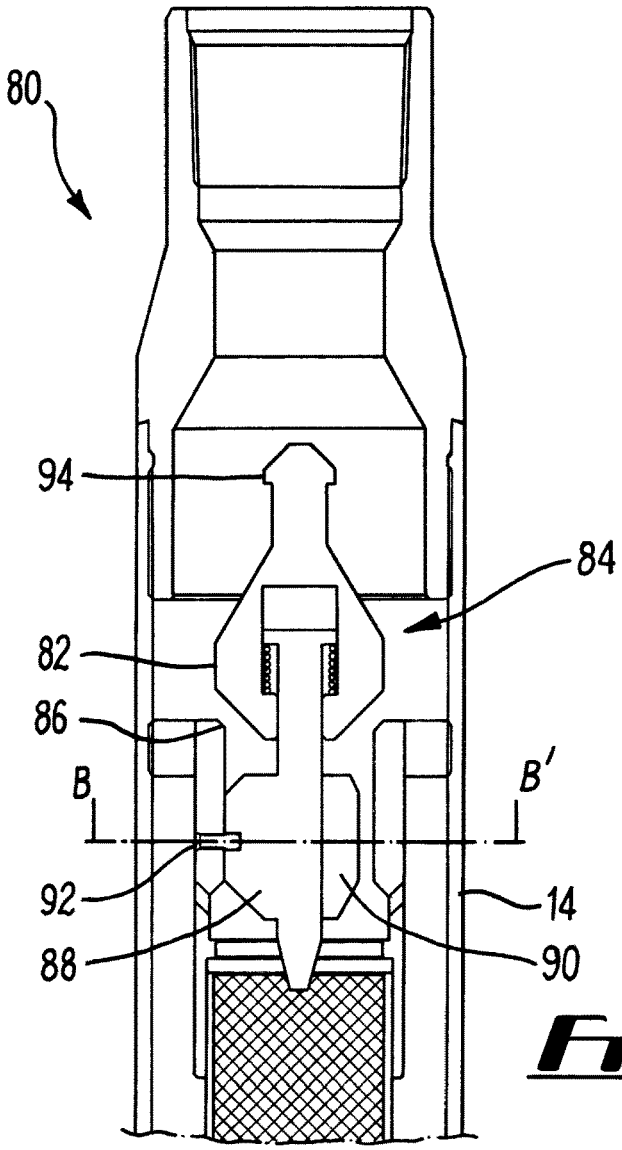
FIGS. 4A and 4B are respectively longitudinal section and cross-sectional views of a downhole apparatus in accordance with a further alternative embodiment of the invention.
Figure 4B:
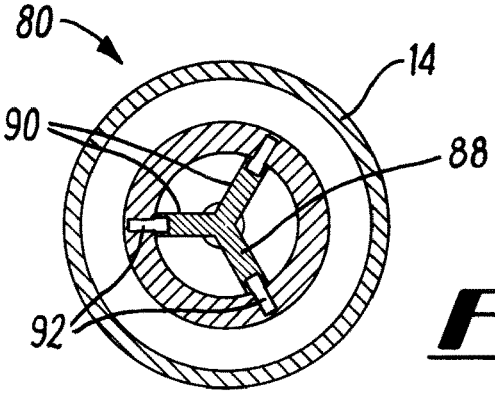

Referring now to FIGS. 4A and 4B, there is shown a further alternative embodiment of the invention, which differs in its valve configuration. FIG. 4A is a longitudinal section through an upper part of an apparatus, generally depicted at 80, and FIG. 4B is a cross-section through the apparatus 80 at line B-B'.

The apparatus is similar to the apparatus 10, and will be understood from FIGS. 1A to 1C and the accompanying text. The apparatus 80 comprises a retrievable valve 84, which is of the mushroom-type, comprising a valve member 82 movable between an open and closed position on a valve mount 88. As before, a spring biases the valve member into a closed position on a valve seat 86.

In this embodiment, the valve mount 88 comprises fins 90 (most clearly shown in FIG. 4B) which are held into the valve seat by shear screws 92. The upper part of the valve member 86 is provided with a standard fish neck formation 94, and is configured to engage with a wireline fishing tool having a complementary socket. Should it be required to remove the valve to gain full bore access to the production tubing, a wireline tool can be run down the production tubing to engage with the fish neck 94. By pulling on the wireline or imparting an upward jar, the shear screws 92 can be sheared and the valve mount 82 released from the valve seat 86. The valve member 82 and valve mount 88 can then be pulled to surface via the wireline. It will be appreciated that other valve types may be provided with a remote retrieval arrangement similar to that shown in FIGS. 4A and 4B.

Figure 5:
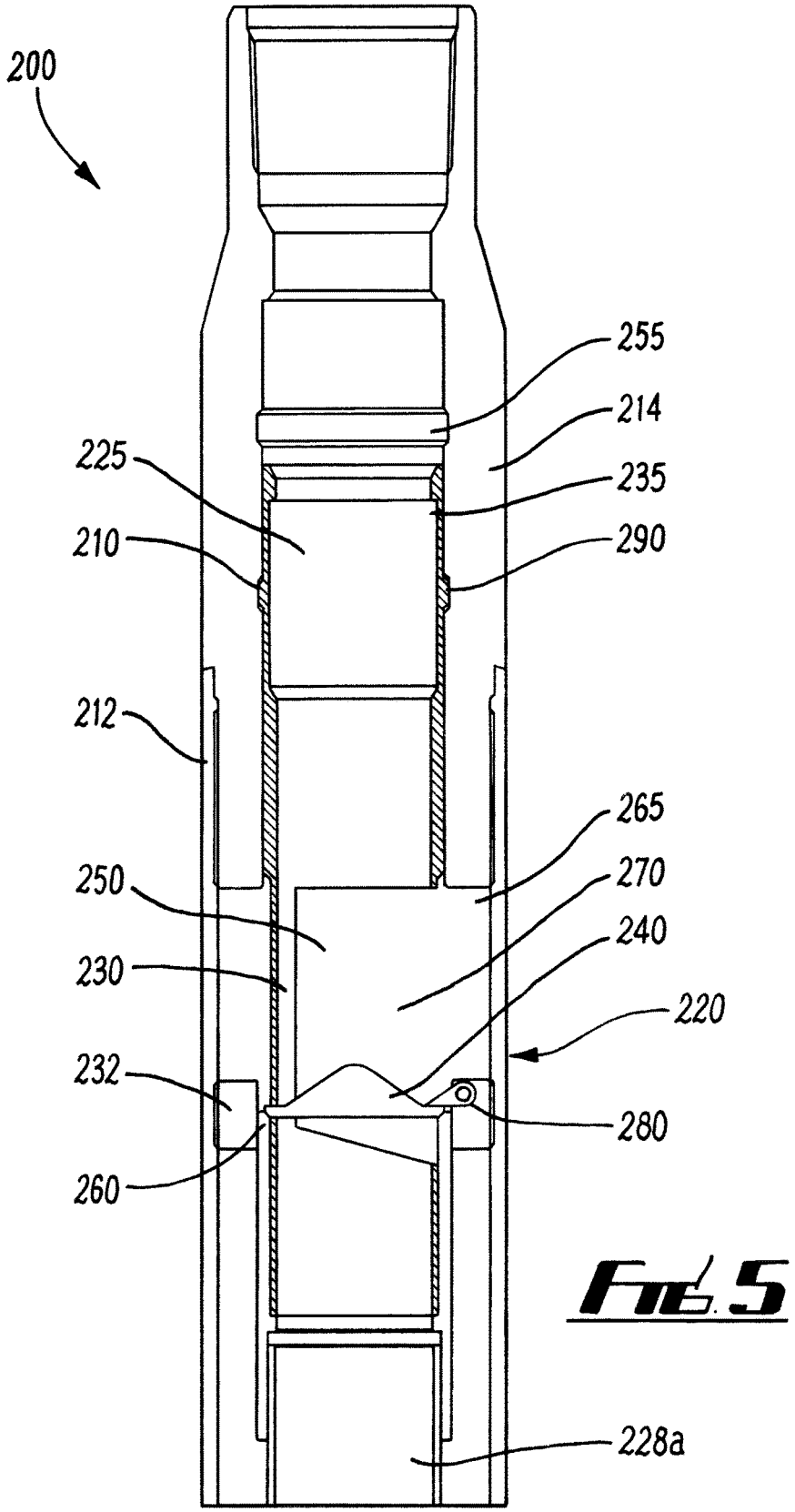
FIG. 5 is part-longitudinal section of a downhole apparatus in accordance with a further alternative embodiment of the invention.

Referring now to FIG. 5, there is shown a further alternative embodiment of the invention, which differs in its valve configuration. FIG. 5 is a longitudinal section through an upper part of an apparatus, generally depicted at 200. The apparatus 200 is similar to the apparatus 10, and will be understood from FIGS. 1A to 1C and the accompanying description. The apparatus 200 comprises a flapper-type valve 220, having a valve member 240 which is pivotally mounted on the spider 232 to move between an open position and a closed position on the valve seat 260. A biasing member is included in a hinge 280 such that in the absence of upward flow, the valve member 240 rests on the valve seat 260. In the closed position, the valve prevents fluid flow into a first flow region 228*a*. A space 265 is provided to accommodate the valve member 240 in the open position.

This particular embodiment enables an intervention to provide full bore access 250 without the need to remove any part of the apparatus. This is achieved by the presence of a sleeve 230, which connects the tubular above the valve to the tubular below it. FIG. 5 shows the sleeve 230 in a lower position, in which a window 270 in the sleeve accommodates the valve member 240 and allows it to move between the open and closed positions. The sleeve is held in the lower position by engaging formations 290 which are received in recesses 210 in the upper subassembly 214. An upper end 225 of the sleeve 230 is provided with a shoulder 235 which can be engaged by an actuating tool (not shown) to pull the sleeve upwards with respect to the body 212 of the apparatus. Upward movement of the sleeve 230 forces the valve member 240 into the open position. The sleeve is retained in an upper position by the engagement of the formations 290 with locking recess 255, and therefore the sleeve locks the valve member 240 into its open position.

The above-described embodiments are particularly suited for use with downhole pumps which are operated by downhole motors, such as ESPs. FIGS. 6A to 6C and 7 illustrate an alternative embodiment of the invention suitable for use with a system which has a shaft extending through the apparatus. This is particularly useful in applications to production systems with progressive cavity pumps (PCPs) which are driven from surface by a drive shaft which extends down the production tubing In FIGS. 6A to 6C, an upper part of the apparatus, generally depicted at 100, is shown in longitudinal section in different phases of operation. FIG. 7 is a part-sectional view from above, showing the shaft and bore in cross section and the petals of the valve in a closed configuration. Again, the apparatus 100 is similar to the apparatus 10, and will be understood from FIGS. 1A to 1C and the accompanying description. Once again, the apparatus 100 differs in details of the valve configuration, which is designed to permit the passage of a drive shaft 101 for a PCP. In this embodiment, the valve comprises a rubber petal valve 104, which has a plurality of petals 106 arranged circumferentially around the drive shaft 101. The valve 104 is engineered to be biased towards the closed position, but the biasing force is sufficiently light so as not to unduly restrict the rotation of the drive shaft to drive the pump.

Figure 6A:
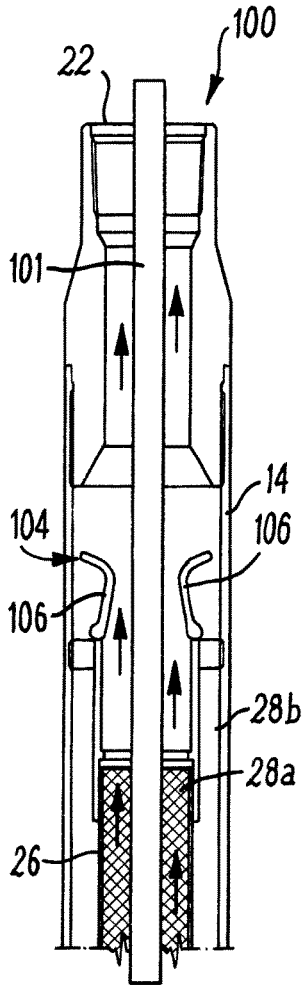
FIGS. 6A to 6C are sectional views of a downhole apparatus in accordance with a further alternative embodiment of the invention in different phases of operation.
Figure 7:
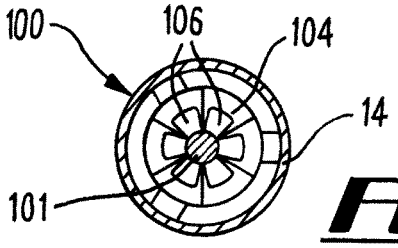
FIG. 7 is a cross-sectional view through a part of the downhole apparatus of FIGS. 6A to 6C.

FIG. 6A shows the apparatus 100 in a production phase. The downhole pump is operating to cause production fluids to flow upwards through the apparatus 100, and with the flow acting against the valve 104, the valve opens away from the drive shaft 101 and allows fluid to flow from the first flow region 28*a* towards the upper opening 22.

Figure 6B:
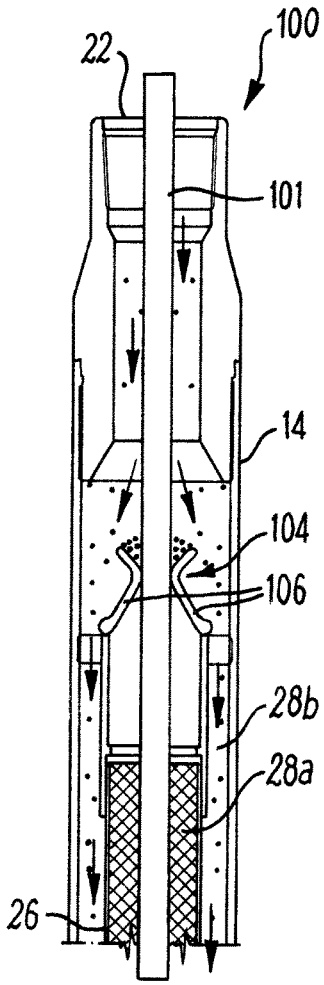

FIG. 6B shows shutdown phase of the production system, in which the downhole pump has ceased. With no pressure acting from below, the valve 104 closes against the drive shaft 101 and prevents flow to the first flow region 28*a* from above. Fluids and/or entrained solids and sand flow downwards in the apparatus 101, and are diverted to the second flow region 28*b* in which the solids and sands accumulate.

Figure 6C:
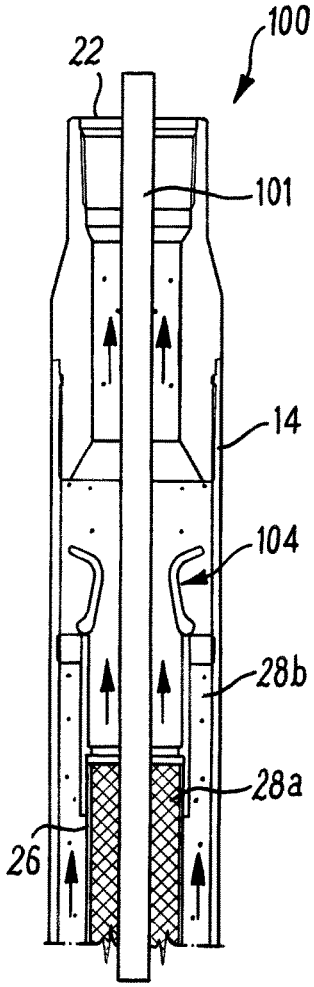

In a subsequent production phase, shown in FIG. 6C, the downhole pump resumes to pump fluid upwards through the apparatus 100 and open the valve 104. Fluid flow in the first flow region 28*a* also induces flow in the second flow region 28*b* to carry sands and solids upwards in the apparatus to rejoin the production flow.

Figure 10:
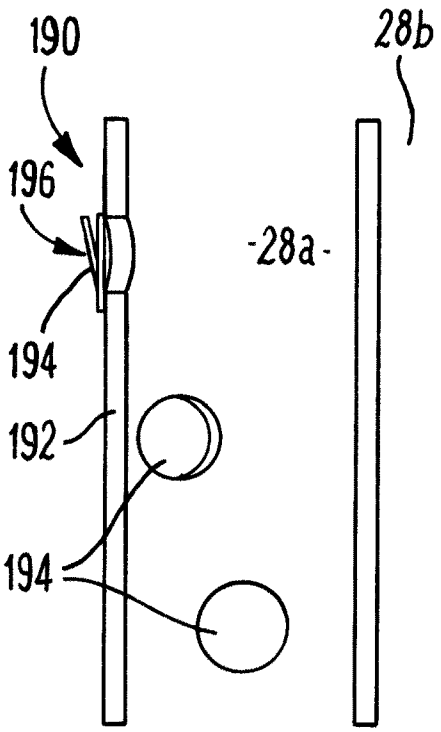
FIGS. 8, 9 and 10 are part-sectional views of vent configurations which may be used in different embodiments of the invention.
Figure 9:
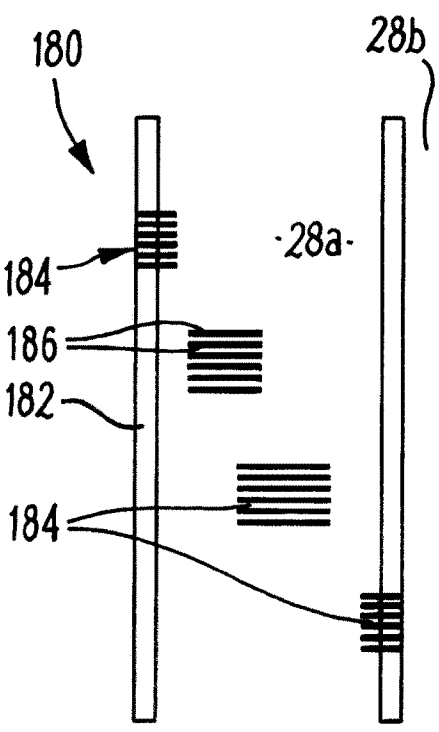
Figure 8:
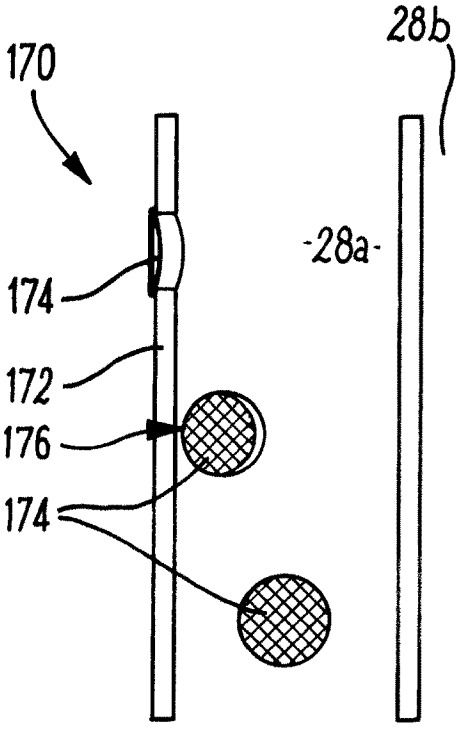

FIGS. 8 to 10 show a range of vent configurations which may be used in various embodiments of the invention, alone or in combination. FIG. 8 shows a first vent configuration 170, showing a wall 172 of the inner tubular comprising a plurality of circular holes 174 which vent the first flow region 28*a* to the second flow region 28*b*. The holes 174 are arranged in a helical pattern on the inner tubular, and are provided with a wire mesh filter or screen 176 on the outer surface to prevent solid particles moving from the second flow region to the first flow region.

FIG. 9 shows an alternative arrangement 180, in which the wall 182 of the inner tubular is provided with a plurality of slots 186 which vent the first flow region to the second flow region. The slots 186 are finely cut in the wall 182, and are formed circumferentially in the tubular. In this arrangement, multiple groups 184 of slots 186 are provided, with multiple groups arranged helically around the tubular. It will be appreciated that the slots could be cut in other orientations in alternative embodiments of the invention, and in further alternatives, a wire mesh screen or filter may be provided over the slots 186.

FIG. 10 shows a further alternative embodiment of the invention at 190. In this embodiment, the vents are circular holes 194 formed with rubber membrane covers 196 which are arranged to open to flow from the inside of the tubular to the outside, and to close to flow from the outside of the tubular to the inside. In use, the rubber membrane 196 covers the holes to prevent flow of fluid from the second flow region 28*b* into the first flow region 28*a*, and therefore prevents the passage of solids and sands downward through the apparatus.

The vents may be arranged in a variety of different configurations, and in some applications it may be advantageous to arrange the vents in a non-uniform distribution or pattern on the apparatus. For example, improved operation may be achieved by increasing the quantity and/or size of vents (and therefore the fluid communication between the first and second flow paths) towards the lower part of the apparatus.

Figure 11:
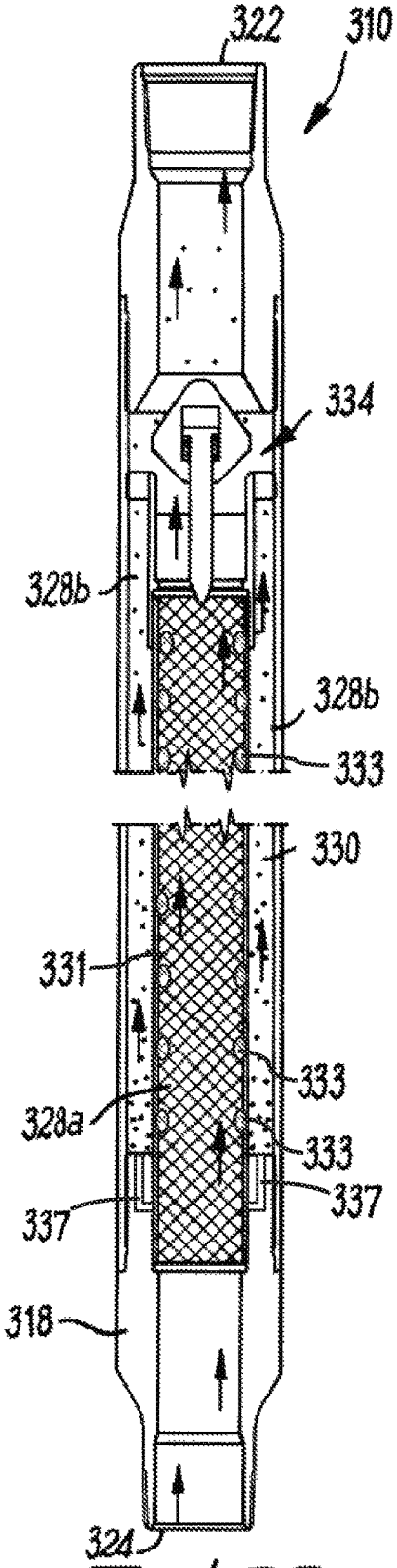
FIG. 11 is a sectional view of a downhole apparatus in accordance with an alternative embodiment of the invention in operation.

It may also be advantageous to provide one or more additional flow paths which introduce an axial flow component at the lower part of the second flow path. For example, as shown in FIG. 11, the apparatus, generally depicted at 310, is similar to the apparatus 10 and will be understood from FIGS. 1A to 1C and the accompanying description. Like features are given like reference numerals incremented by 300. One or more holes 337 may be arranged between the lower part of the first flow path 328*a* and the second flow path 328*b* through the lower subassembly 318 to receive upward flow from the main flow path. This may stimulate flow at the bottom of the second flow path and assist with the solids from being washed away from a lower part of the second flow path.

The invention provides a downhole apparatus comprising a body configured to be coupled to a production tubular and an upper opening and a lower opening. First and second flow paths are provided between the upper opening and the lower opening in the body, and a flow diverter is arranged to direct downward flow through the body towards the second flow path and away from the first flow path. A filter device in the second flow path filters or collects solid particles in the second flow path from passing out of the lower opening of the apparatus. The apparatus has particular application to artificial lift hydrocarbon production systems, and may be installed above a downhole pump in a production tubing to prevent solids from settling on the pump during pump shutdown. Embodiments for use with ESPs and PCPs are described.

Various modifications may be made within the scope of the invention as herein intended, and embodiments of the invention may include combinations of features other than those expressly claimed. In particular, flow arrangements other than those expressly described herein are within the scope of the invention. For example, although the described embodiments include a first flow path corresponding to a main through bore of the apparatus, and a second flow path in an annular space, this is not essential to the invention. Other flow paths may be used. However, the flow arrangement of the described embodiments has been recognised by the inventors to efficiently allow solid particles and sands collected and accumulated in the second flow path to be entrained in the production flow during the subsequent production phase. Multiple downhole apparatus according to the invention may be used in combination in a production tubing. One apparatus may be provided in proximity to the downhole pump, with another further up in the tubing string. One or more of the apparatus may be configured for intervention (for example to recover full-bore access), but this may not be required for the lower apparatus.

It will be appreciated that combinations of features from different embodiments of the invention may be used in combination.

The invention claimed is:

1. A downhole production apparatus comprising:

a body configured to be coupled to a production tubing, the body comprising an upper opening and a lower opening and further configured to be installed above a downhole pump;

a first flow path between the upper opening and the lower opening in the body;

a second flow path between the upper opening and the lower opening in the body, wherein a bottom part of the second flow path is arranged to collect solid particles when the downhole pump is shut down;

a flow diverter arranged to direct solid particles moving downwardly in the body towards the second flow path and away from the first flow path; and one or more vents arranged between a lower part of the first flow path and the second flow path to wash away collected solid particles from a lower part of the second flow path when production fluid flows upwardly in the first flow path.

2. The apparatus as claimed in claim 1, comprising one or more holes in a bottom surface of the second flow path and arranged to receive upward production flow caused by the downhole pump.

3. The apparatus as claimed in claim 1, comprising one or more holes arranged between a bottom part of the first flow path and the second flow path through a lower subassembly of the apparatus.

4. The apparatus as claimed in claim 1, wherein the first flow path is a main throughbore of the apparatus, which is aligned with the main bore of a production tubing.

5. The apparatus as claimed in claim 1, wherein the second flow path is located in an annular space between the first flow path and a wall of the body.

6. The apparatus as claimed in claim 5, wherein the second flow path comprises an annular flow path disposed around the first flow path.

7. The apparatus as claimed in claim 1, wherein the first and second flow paths are in fluid communication with one another via one or more upper vents arranged between an upper part of the first flow path and an upper part of the second flow path.

8. The apparatus as claimed in claim 1, wherein the flow diverter comprises a valve.

9. The apparatus as claimed in claim 8, wherein the valve is configured for intervention from surface.

10. The apparatus as claimed in claim 9, wherein the valve is configured to be removed from the well by a wireline intervention.

11. The apparatus as claimed claim 1, wherein the apparatus is configured to accommodate the passage of a drive shaft for the downhole pump.

12. The apparatus as claimed in claim 11, wherein the flow diverter comprises a petal valve.

13. The apparatus as claimed in claim 1, wherein a mesh or screen is disposed over at least one of the one or more vents.

14. The apparatus as claimed claim 1, wherein the one or more vents comprise a one-way valve operable to be closed to limit passage of solids from the second flow path to the first flow path, and to open to allow flow from the first flow path to the second flow path.

15. The apparatus as claimed in claim 1, wherein at least one of the one or more vents is sized or shaped to limit the passage of downward moving solid particles from the second flow path to the first flow path when the downward moving solid particles are entrained in a downward flowing fluid.

16. The apparatus as claimed in claim 15, wherein the at least one or more vents have a dimension of around 0.5 mm or less.

17. The apparatus as claimed in claim 1, wherein the downhole pump is an electrical submersible pump (ESP).

18. The apparatus as claimed in claim 1, wherein the downhole pump is a progressive cavity pump (PCP).

19. The apparatus as claimed in claim 1, wherein the flow diverter has a downward sloping or downward angled shape to assist with directing solid particles moving downwardly in the body.

20. The apparatus as claimed in claim 1, wherein at least part of the flow diverter is movable.

21. The apparatus as claimed in claim 1, wherein the flow diverter is arranged to direct solid particles entrained in a downward flowing fluid towards the second flow path and away from the first flow path.

22. The apparatus as claimed in claim 1, wherein the flow diverter is arranged to direct solid particles moving downward through a stationary column of fluid in the body towards the second flow path and away from the first flow path.

23. The apparatus as claimed in claim 1, wherein at least one or the one or more vents is a slot.

24. A downhole production apparatus comprising:

a body configured to be coupled to a production tubular, the body comprising an upper opening and a lower opening and further configured to be installed above a downhole pump;

a first flow path between the upper opening and the lower opening in the body;

a second flow path between the upper opening and the lower opening in the body, wherein a bottom part of the second flow path is arranged to collect solid particles;

a flow diverter arranged to direct solid particles moving downwardly in the body towards the second flow path and away from the first flow path; and a filter between a lower part of the second flow path and a lower part of the first flow path, wherein fluid flowing in the first flow path in an upward direction causes fluid flow in the second flow path which carries filtered or collected solid particles away from the apparatus.

25. The apparatus as claimed in claim 24, wherein the filter comprises one or more vents arranged between a lower part of the first flow path and the second flow path.

26. The apparatus as claimed in claim 25, wherein the at least one or more vents have a dimension of around 0.5 mm.

27. The apparatus as claimed in claim 25, wherein at least one of the one or more vents is a slot.

28. The apparatus as claimed in claim 24, wherein the filter comprises a screen or mesh.

29. The apparatus as claimed in claim 24, wherein the filter comprises a screen or mesh disposed over one or more vents.

30. The apparatus as claimed in claim 24, comprising one or more holes in a bottom surface of the second flow path and arranged to receive upward production flow caused by the downhole pump.

31. The apparatus as claimed in claim 24, comprising one or more holes arranged between a bottom part of the first flow path and the second flow path through a lower subassembly of the apparatus.

32. A hydrocarbon production system comprising:

a production tubing; and a downhole apparatus according to claim 1 coupled into the production tubing;

wherein the downhole pump is coupled to the production tubing below the downhole apparatus.

33. A hydrocarbon production system comprising: a production tubular tubing; and a downhole apparatus according to claim 24 coupled into the production tubing; wherein the downhole pump is coupled to the production tubular below the downhole apparatus.

34. A method of operating a hydrocarbon production system comprising a production tubular, a downhole pump in the production tubular, and a downhole apparatus coupled to the production tubular above the downhole pump, the method comprising:

in a production phase, operating the downhole pump to cause fluid to flow in a first flow path upward through the downhole apparatus;

ceasing operation of the downhole pump;

diverting downward moving solids to a second flow path in the downhole apparatus;

filtering or collecting solid particles moving downwardly in the second flow path;

operating the downhole pump to cause production to flow upwardly in the first flow path and to induce upward flow in the second flow path via at least one or more vents arranged between a lower part of the first flow path and a lower part of the second flow path, such that the induced upward flow washes away solids from a lower part of the second flow path.

35. The method as claimed in claim 34, further comprising carrying filtered or collected solid particles out of an upper opening of the downhole apparatus.

36. The method as claimed in claim 34, comprising directing flow towards a lower surface of a volume of solids collected in the downhole apparatus through one or more holes arranged between a lower part of the first flow path and the second flow path.

37. A method of operating a hydrocarbon production system comprising a production tubular, a downhole pump in the production tubular, and a downhole apparatus coupled to the production tubular above the downhole pump, the method comprising:

operating the downhole pump to cause production to flow upwardly in a first flow path of the downhole apparatus, and induce upward flow in a second flow path of the downhole apparatus via at least one or more vents arranged between a lower part of the first flow path and a lower part of the second flow path, such that the induced upward flow in the second flow path washes away solids that have previously been diverted to the second flow path and collected in a lower part of the second flow path.

38. The method as claimed in claim 37, further comprising carrying filtered or collected solid particles out of an upper opening of the downhole apparatus.

* * * * *